US005269529A

United States Patent [19]

Clemente

[11] Patent Number: 5,269,529

[45] Date of Patent: Dec. 14, 1993

[54] PEGBOARD GAME APPARATUS

[76] Inventor: Jose R. Clemente, 16850 NE. 3 Ct., Miami, Fla. 33162

[21] Appl. No.: 14,748

[22] Filed: Feb. 8, 1993

[51] Int. Cl.[5] ..... A63F 3/00

[52] U.S. Cl. ..... 273/238; 273/248; 273/290

[58] Field of Search ..... 273/248-252, 273/238, 258, 290

[56] References Cited

U.S. PATENT DOCUMENTS

| | | | |
|---|---|---|---|
| 486,308 | 11/1892 | Watt | 273/290 |
| 695,303 | 3/1902 | Graham | 273/249 |
| 2,470,632 | 5/1949 | McLeod | 273/252 |
| 2,766,988 | 10/1956 | Haumersen | 273/238 |
| 2,852,863 | 9/1958 | Homan | 273/238 |
| 3,363,902 | 1/1968 | Jones | 273/290 |
| 4,004,810 | 1/1977 | Henrie | 273/249 |
| 4,046,381 | 9/1977 | Comeaux | 273/249 |
| 4,331,333 | 5/1982 | Willcocks | 273/238 |
| 4,998,735 | 3/1991 | Blackwell | 273/249 |

*Primary Examiner*—Benjamin H. Layno
*Attorney, Agent, or Firm*—Leon Gilden

[57] ABSTRACT

A game apparatus arranged to simulate the crowning of kings, wherein a player to dispose his tokens in a king form in an opposing player's home spaces adjacent an outer periphery of the game board is arranged, wherein the pegs are arranged for a nesting configuration relative to one another to effect a king designation. A dice member is directed to move the pegs about predetermined bores within the game board directing the pegs to a primary central space within each board segment for crowning of a king.

1 Claim, 6 Drawing Sheets

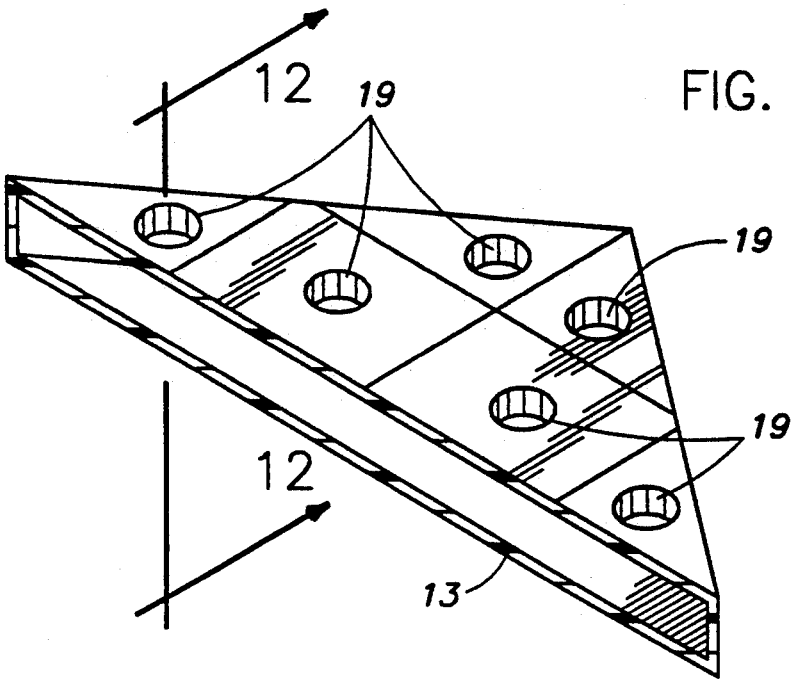
FIG. 11
FIG. 12
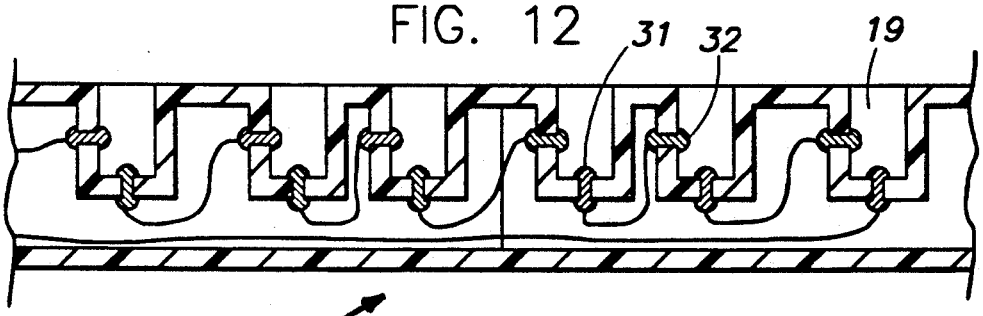
FIG. 13
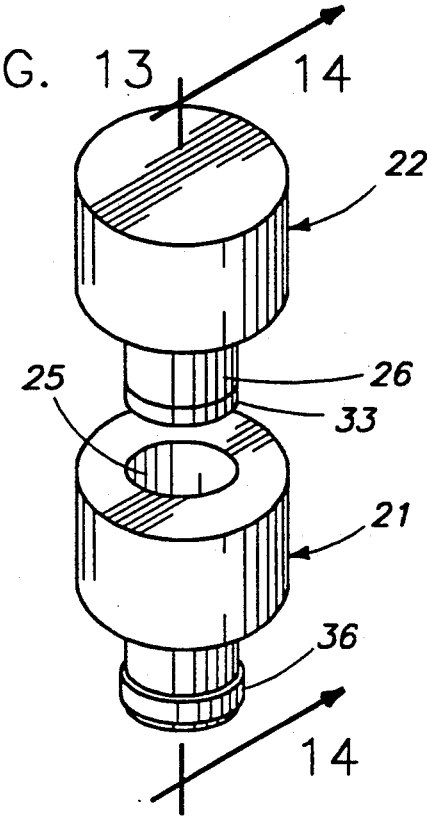
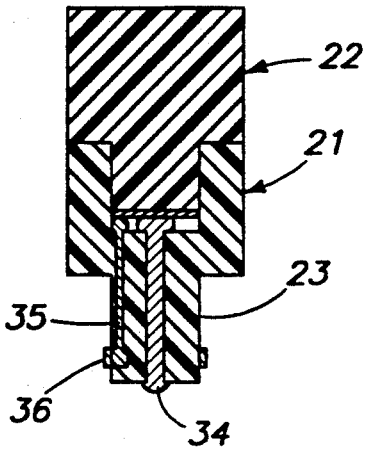
FIG. 14

PEGBOARD GAME APPARATUS

BACKGROUND OF THE INVENTION

1. Field of the Invention

The field of invention relates to pegboard game apparatus, and more particularly pertains to a new and improved pegboard game apparatus wherein the same is arranged to manipulate peg members about a game board in an effort to reach a first destination to create a king designation among the pegs and subsequently direct the pegs to an opposing player's home spaces.

2. Description of the Prior Art

Pegboard game apparatus of various types have been utilized in the prior art for the entertainment and amusement of individuals and exemplified by the U.S. Pat. Nos. 4,535,993; 4,522,408; 4,239,230; and 3,693,976.

The instant invention sets forth a new and distinct pegboard structure to direct game tokens of pegs throughout a game board having prenumbered and predesignated spaces and in this respect, the present invention substantially fulfills this need.

SUMMARY OF THE INVENTION

In view of the foregoing disadvantages inherent in the known types of pegboard game apparatus now present in the prior art, the present invention provides a pegboard game apparatus wherein the same employs nesting peg members directed throughout a peg board to direct the pegs from an origin to an opposing destination of an opposing player's board segment to thereby upon positioning all such nested or "king" peg members promote a winner of the game in use. As such, the general purpose of the present invention, which will be described subsequently in greater detail, is to provide a new and improved pegboard game apparatus which has all the advantages of the prior art pegboard game apparatus and none of the disadvantages.

To attain this, the present invention provides a game apparatus arranged to simulate the crowning of kings, wherein a player disposes his tokens in a king form in an opposing player's home spaces adjacent an outer periphery of the game board, wherein the pegs are arranged for nesting configuration relative to one another to effect a king designation. A dice member is directed to move the pegs about predetermined bores within the game board directing the pegs to a primary central space within each board segment for crowning of a king.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved pegboard game apparatus which has all the advantages of the prior art pegboard game apparatus and none of the disadvantages.

It is another object of the present invention to provide a new and improved pegboard game apparatus which may be easily and efficiently manufactured and marketed.

It is a further object of the present invention to provide a new and improved pegboard game apparatus which is of a durable and reliable construction.

An even further object of the present invention is to provide a new and improved pegboard game apparatus which is susceptible of a low cost of manufacture with regard to both materials and labor, and which accordingly is then susceptible of low prices of sale to the consuming public, thereby making such pegboard game apparatus economically available to the buying public.

Still yet another object of the present invention is to provide a new and improved pegboard game apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 11 is an isometric illustration of section 11 as set forth in FIG. 9.

FIG. 12 is an orthographic view, taken along the lines 12—12 of FIG. 11 in the direction indicated by the arrows.

FIG. 13 is an isometric illustration of inter-nested peg members of the invention.

FIG. 14 is an orthographic view, taken along the lines 14—14 of FIG. 13 in the direction indicated by the arrows.

DESCRIPTION OF THE PREFERRED EMBODIMENT

Figure 1:
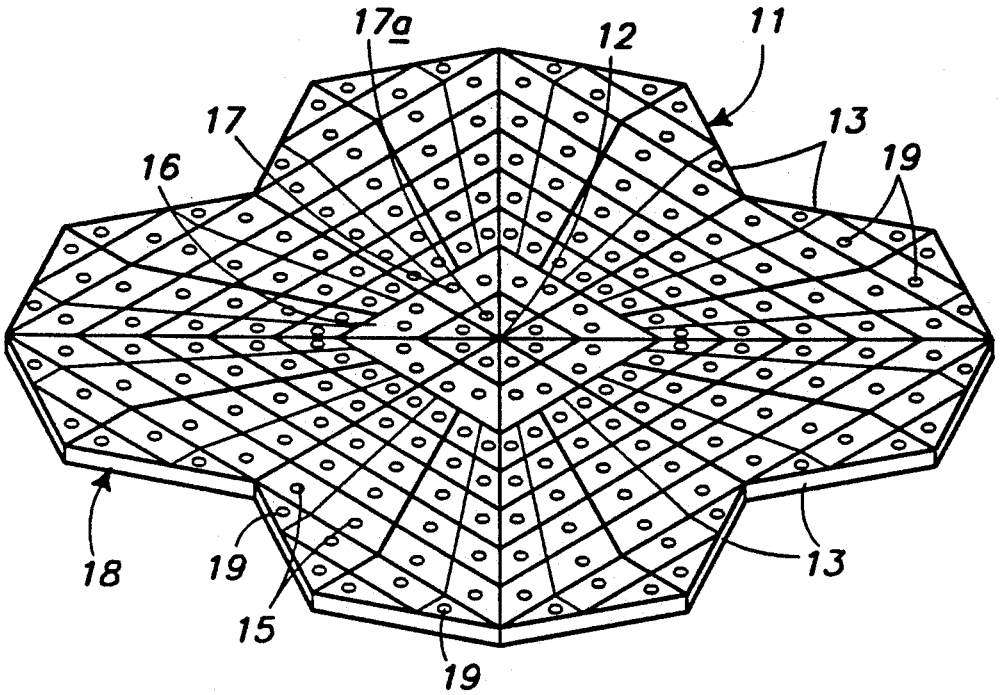
FIG. 1 is an isometric illustration of the game board of the invention.
Figure 2:
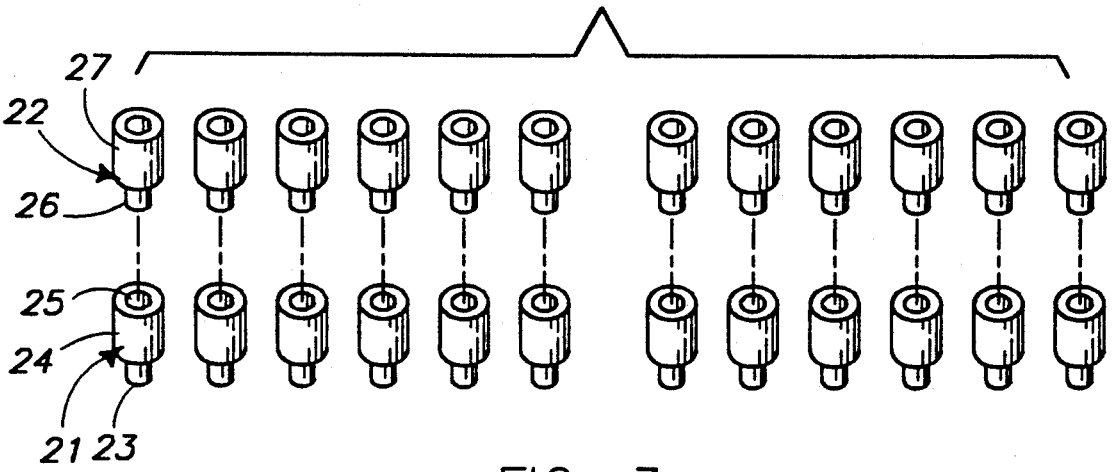
FIG. 2 is an isometric illustration exemplary of sets of peg members employed by each player.

With reference now to the drawings, and in particular to FIGS. 1 to 15 thereof, a new and improved pegboard game apparatus embodying the principles and concepts of the present invention and generally designated by the reference numerals 11-36 will be described.

Figure 3:
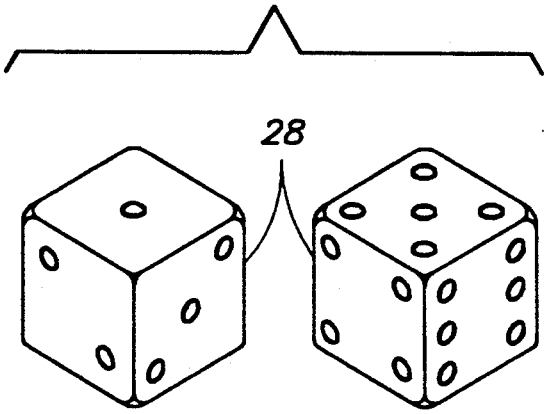
FIG. 3 is an isometric illustration of the dice member employed by the invention.
Figure 4:
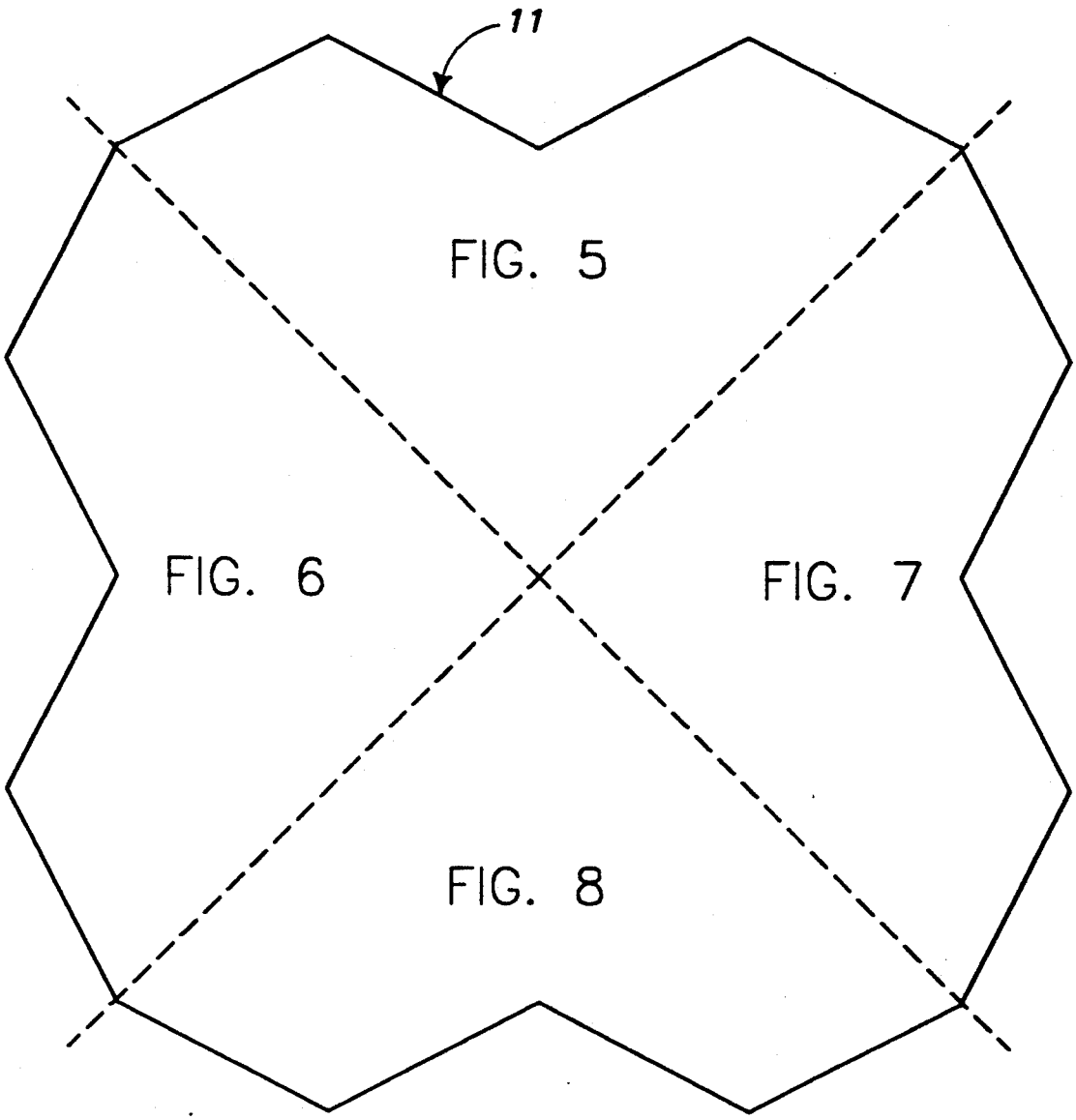
FIG. 4 is an orthographic diagram view of the game board structure and perimeter configuration.
Figure 5:
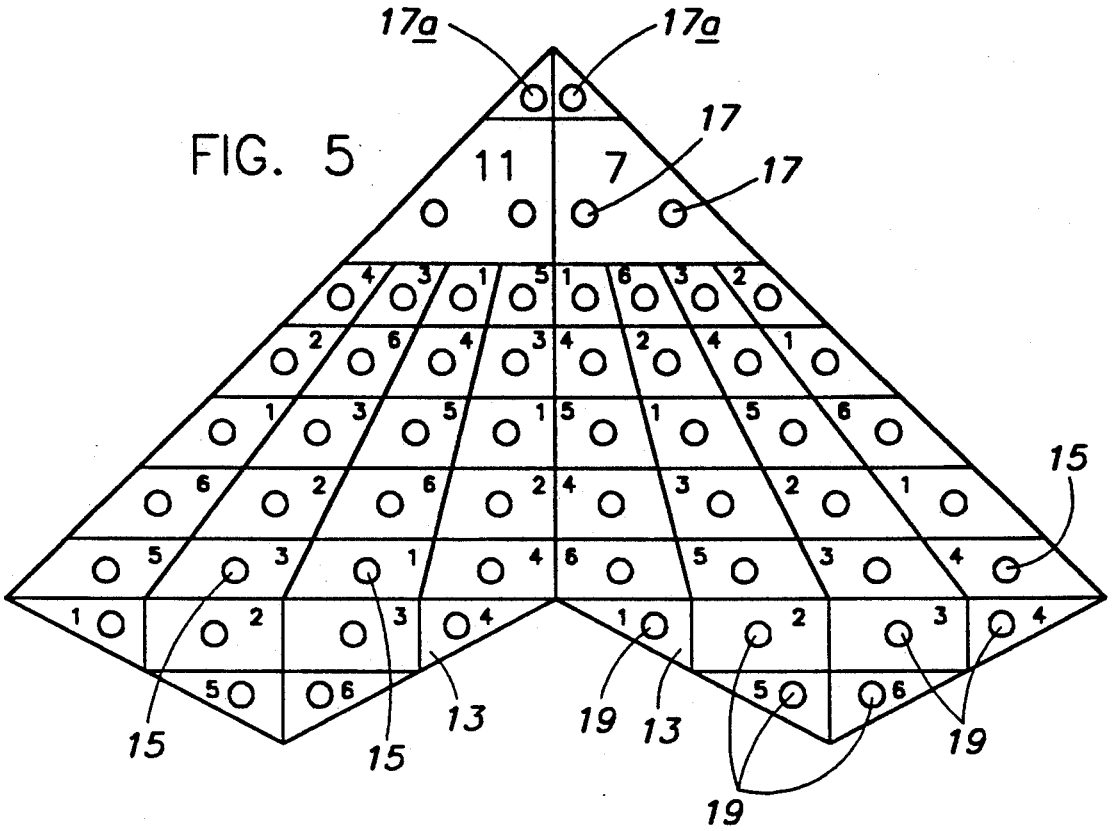
FIG. 5 is an orthographic view of section 5 as set forth in FIG. 4.
Figure 6:
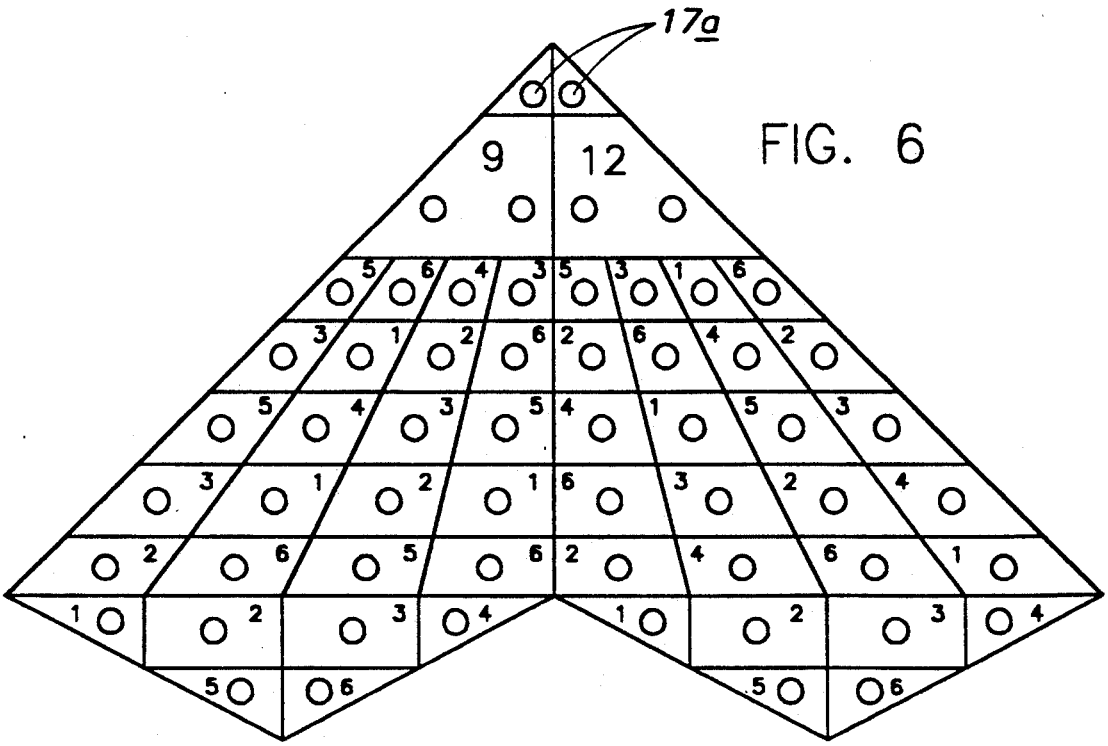
FIG. 6 is an orthographic view of section 6 as set forth in FIG. 4.
Figure 7:
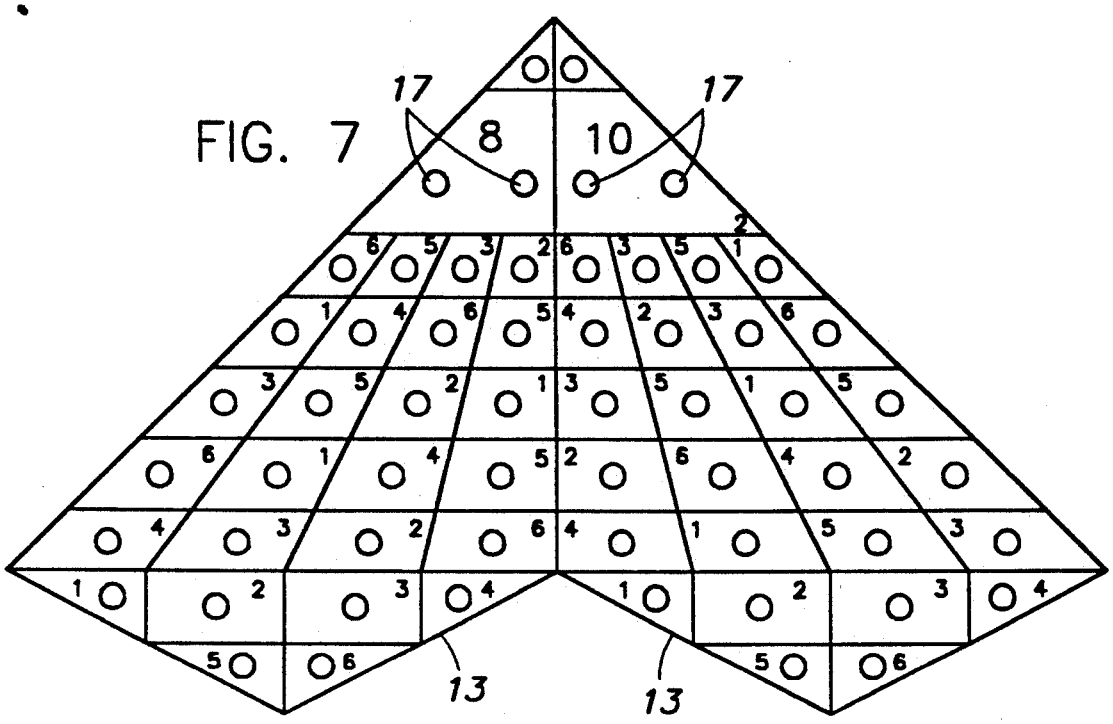
FIG. 7 is an orthographic view of section 7 as set forth in FIG. 4.
Figure 8:
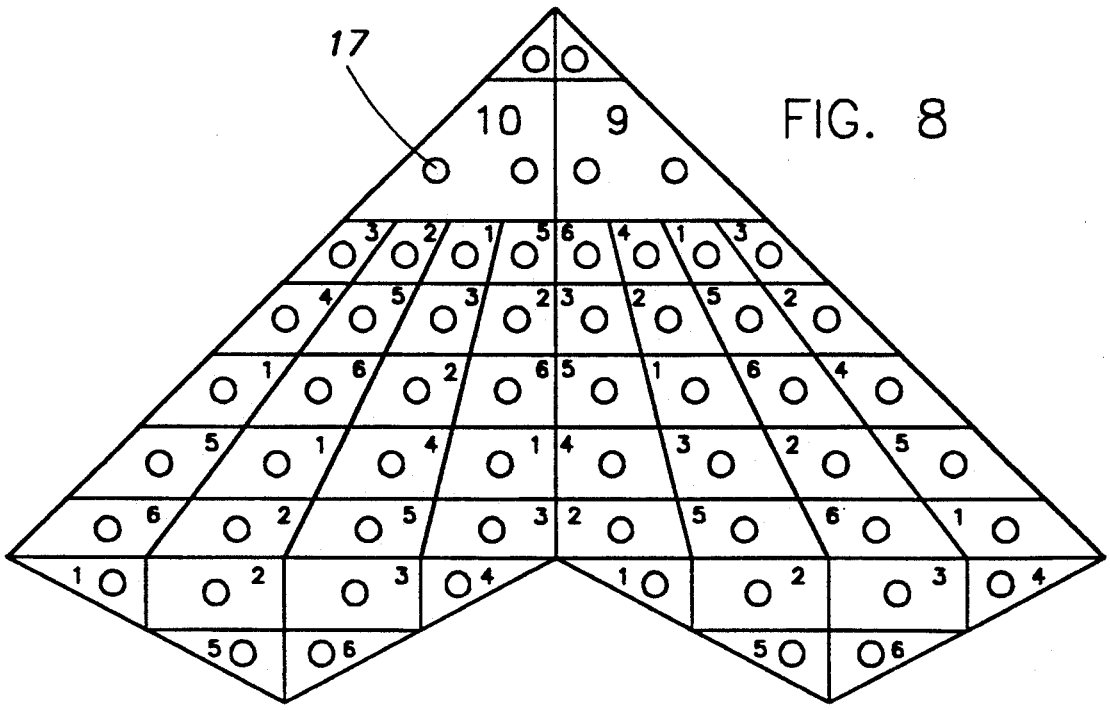
FIG. 8 is an orthographic view of section 8 as set forth in FIG. 4.

More specifically, the pegboard game apparatus of the invention includes a game board 11, having a radial center 12 and a plurality of wedge segments 13 directed from the game board outer periphery 18 towards the radial center. Each of the segments is arranged to provide for a plurality of primary central peg bores 17*a* in adjacency and in surrounding relationship relative to the radial center, and an outer annular array of central peg bores 17. The outer array of peg bores are numbered from 7-12 requiring an individual employing the dice members 28 to roll a seven through twelve to permit entry into the outer central pegboard array of bores 17 permitting subsequent positioning of an individual peg 21 into the "throne" or perimeter central peg bore 17*a* to permit the crowning of a peg set, in a manner as indicated in FIG. 3, by directing a second peg member 22 having a second peg rod 26 fixedly mounted to a second peg housing 27. The second peg rod 26 is directed into a first peg bore 25 coaxially aligned relative to the first peg rod 23 of a first peg housing 24 to provide for a coaxially aligned array of the first and second pegs 21 and 22.

Each player is awarded initially six first pegs 21 and six second pegs 22. The second pegs 22 are employed in the formation of a "king" when the first pegs are permitted reception into a throne or primary central peg bore 17*a*. Each of the wedge segments 13, and typically eight are provided, includes a matrix of home base peg bores 19 typically equal to the predetermined number of first pegs 21, in this instance the number six is employed, wherein six such home base peg bores 19 are positioned adjacent the outer periphery 18 of each of the segments 13. In each player's home base of peg bores 19, the pegs are directed to play to traverse the matrix of intermediate peg bores 15 that are individually numbered from one to six, in a manner as indicated in FIGS. 5-8. The prenumbering of the intermediate peg bores 15 are so numbered for association with the numbering of the dice members 28 of the individual dice members to thereby direct pegs into a like numbered peg bore of the intermediate peg bores in association with a generated number by the dice members when thrown by each individual player's turn. In this manner, the pegs are directed throughout the game board in any manner of vertical, horizontal, and angular orientation to initially direct the individual first pegs to the throne or primary central bore 17*a* and upon being crowned as a "king", the pegs are then directed to an opposing player's matrix and array of home base peg bores 19. Upon any player having effected the "king" or the nested array of the second pegs 22 with each first peg 21 and thereafter directing all of such king pegs into an opposing player's array of home spaces 19, is declared a winner.

Figure 9:
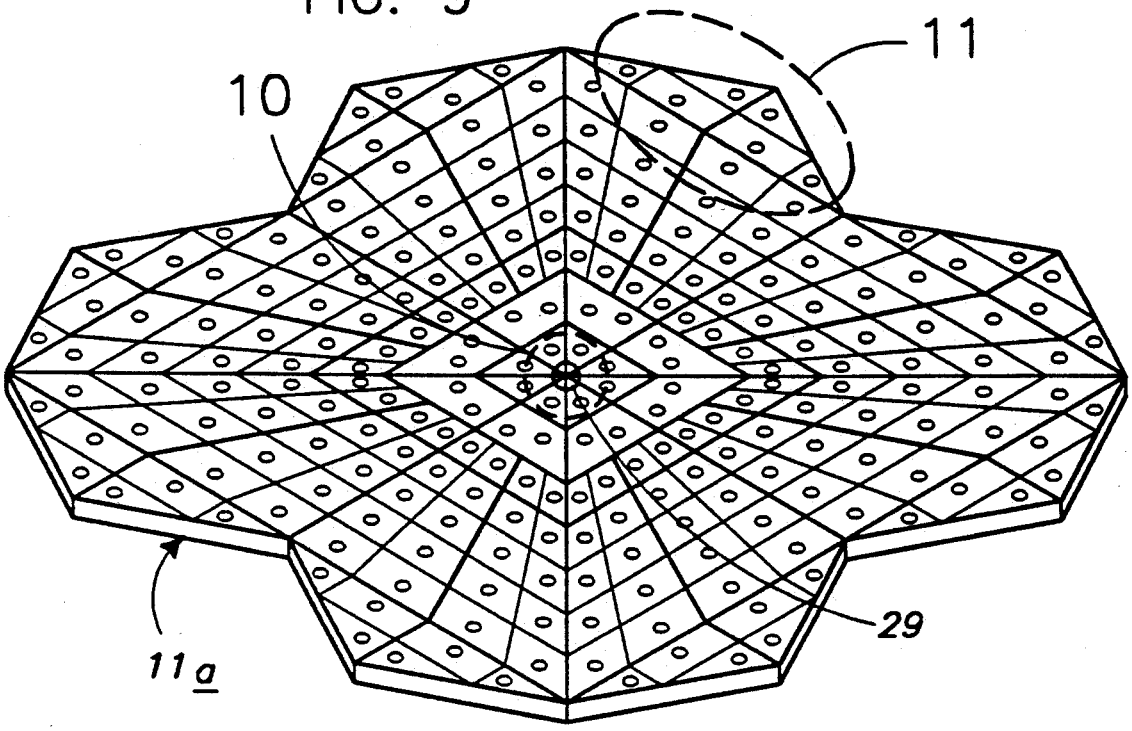
FIG. 9 is an isometric illustration of the game board structure employing indicator illumination means.
Figure 10:
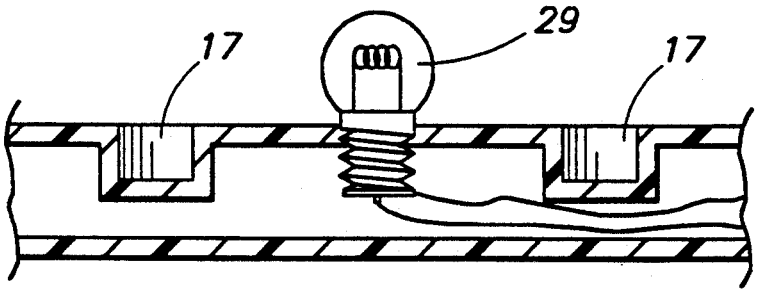
FIG. 10 is an enlarged cross-sectional view of the illumination bulb mounted within the gameboard.
Figure 15:
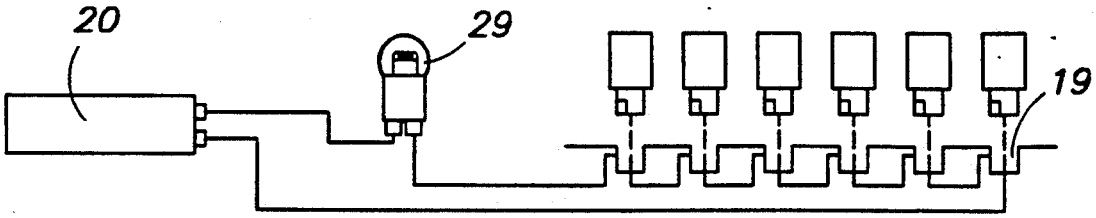
FIG. 15 is a diagrammatic illustration of the electrical circuitry employed by the invention.

The FIG. 9 indicates a modified game board 11*a*, wherein in addition to the game board structure as previously noted, the radial center 12 has mounted thereto an illumination bulb 29. The illumination bulb is wired in electrical series, with each array of home base peg bores 19 in cooperation with a battery 20. Upon a player directing each of the assembled first and second pegs 21 and 22 in a king construction of the first and second pegs, and the mounting of each of the thusly associated pegs 21 and 22 into all of the predetermined number of home base peg bores 19, the illumination bulb 19 will be illuminated to indicate visually a winner. It is to be understood that in lieu of a single illumination bulb 29, for all of the segments 13, each segment may employ an individual illumination bulb mounted at the radial center 12. To this end, reference to the FIGS. 11-14 are arranged to note that each of the home base peg bores 19 of the game board 11*a* include a first electrical contact 31 on a floor of each of the home base peg bores, and a second electrical contact 32 in a cylindrical side wall of each of the home base peg bores 19. To effect electrical intercommunication by the assembly of nested peg bores and the king designation, the reference to FIGS. 13 and 14 is required. The first peg 21 includes first peg first contact lug 34 directed coaxially of the first peg rod 23 projecting from a bottom surface of the first peg rod, with a second contact lug 35 directed adjacent an outer periphery of the first peg rod 23 within the first peg rod in electrical communication with a first peg rod annular contact ring 36. The first peg bore first contact lug 34 is arranged for electrical communication with the first electrical contact 31, while the first peg rod annular contact ring 36 is arranged for electrical communication with the second electrical contact 32 within each respective home base peg bore 19. The second peg 22 includes its second peg rod 26 having an electrical conductive plate 33 mounted at a bottom wall of the second peg rod 26 to effect electrical intercommunication of the first peg bore first contact lug 34 that extends into the first peg bore 25 in a spaced relationship relative to the first peg bore second contact lug 35. The spaced first peg bore first and second contact lugs 34 and 35 are thereby in electrical communication relative to one another by the electrically conductive plate 33, in a manner as indicated in FIG. 14, to thereby effect electrical intercommunication between the first and second electrical contacts 31 and 32 within each home base peg bore 19. In this manner, the circuitry is completed, in a manner as indicated in FIG. 15, when all of the thusly nested individual kings of first and second pegs 21 and 22 are interfitted within an opposing player's array of home base peg bores 19 to effect illumination of the bulb 29.

Rules as to play of the game may vary, wherein the players initially ascertain as to which player is to begin play and to this end, the players may throw the dice 28 and the player with the highest score is to begin play, and a player with the second highest score is to take a subsequent turn in a like hierarchy of turns among the players. For visual effect and distinction between the various players, each of the segments 13, as well as each set of first and second pegs 21 and 22 afforded each player, may be of a contrasting coloration such as orange, black, yellow, green, brown, purple, red, and blue respectively. The players play with both dice 28 and when a player throws a double, that player may roll the dice again for further play. If that player throws a third double or like designations among the dice members 28, that player loses a turn and that player's peg 21 that is most proximate to the primary central peg bore 17*a* must return to that player's home base spare pegs 19 to again traverse the game board towards the primary central peg bore 17*a* in an effort to effect status as a "king". Each player may upon throwing both dice move an individual peg 21 or may move a plurality of individual pegs, i.e. one for each of the dice members 28 and that dice member's designated number generated from a throw. A player may jump over his peg or an opponent's peg insofar as a peg bore of the peg bores 19, 15, 17, and 17*a* are open. A player entering the primary central peg bore 17*a* from a prenumbered outer central peg bore 17 must exit that primary central peg bore through the predesignated number of outer central peg bores 17 thusly selected. For example, should a player enter the primary central peg bore 17*a* through the number 9, he must exit in that same direction through the number 9. Further, the appropriate packaging and use of a container to house the organization of any desired construction is contemplate in use and such container construction is subject to the commercially available container construction available in the prior art and its details are not believed to be controlling as to the particularly constructed containers to be employed.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A pegboard game apparatus, comprising, a game board, the game board having an outer periphery and a radial center, with a plurality of wedge segments of equal predetermined configuration extending from the outer periphery to the radial center, with each of the segments of a contrasting coloration, and each of the segments having a predetermined number of home base peg bores, a further predetermined number of intermediate peg bores extending from the home base peg bores in a spaced relationship relative to the radial center, and a primary central peg bore adjacent the radial center, and a plurality of outer central peg bores intermediate the primary central peg bore and the intermediate peg bores, and each of the segments having a plurality of first peg rods equal to the predetermined number received within said home base peg bores of each respective segment, and each of the first pegs are arranged to receive a second peg, when each of the first pegs traverse the game board from the home base peg bores to the primary central peg bore; and including a plurality of six-sided dice members, and each of the home base peg bores and the intermediate peg bores are numbered form one through six in a random relationship, and the outer central peg bores are numbered in a predetermined total from seven through twelve requiring the plurality of dice members to attain such total permitting access of the first peg rods into the central peg bores for subsequent movement to the primary central peg bore, whereupon movement of each individual peg to the primary peg bore permits positioning in a coaxially aligned relationship of one of said second pegs into one of said first pegs, and wherein each of the first pegs includes a first peg rod, a first peg rod housing, and the first peg rod housing having a first peg rod housing bore, and each second peg of the second peg rod receivable within one of said first peg rod housing bores, and each second peg rod includes a second peg rod housing, and including an illumination bulb mounted to the radial center, and each of the plurality of home base peg bores in electrical communication with a battery and the illumination bulb, and each of the home base peg bores includes a home base peg bore floor having a first electrical contact and a home base interior side wall having a second electrical contact spaced from the first electrical contact, and each first peg rod includes a first peg first contact lug extending through the first peg rod into the first peg housing bore, and each first peg having a first peg second contact lug directed in a spaced relationship relative to the first peg contact lug extending into the first peg rod housing bore in a spaced relationship relative to the first peg first contact lug within the first peg rod housing bore, and the first peg second contact lug extends from the first peg housing bore to a first peg rod annular contact ring mounted in surrounding relationship relative to each respective first peg rod, wherein the first peg rod annular contact ring is arranged for electrical communication with the second electrical contact, and the first peg first contact lug is arranged for electrical communication with the first electrical contact, and each second peg includes an electrical conductive plate mounted to the second peg rod at a lowermost distal end of the second peg rod to effect electrical communication between the first peg first contact lug and the first peg second contact lug within the first peg rod housing.

* * * * *